United States Patent [19]

Meguro et al.

[11] Patent Number: 4,525,222

[45] Date of Patent: Jun. 25, 1985

[54] METHOD OF HEAT-TREATING AMORPHOUS MATERIAL

[75] Inventors: Takashi Meguro, Yasugi; Yasunobu Ogata, Kumagaya; Yoshizo Sawada, Saitama, all of Japan

[73] Assignee: Hitachi Metals, Ltd., Tokyo, Japan

[21] Appl. No.: 609,837

[22] Filed: May 14, 1984

Related U.S. Application Data

[63] Continuation of Ser. No. 368,867, Apr. 15, 1982, abandoned.

[30] Foreign Application Priority Data

Apr. 24, 1981 [JP] Japan ..... 56-62026

[51] Int. Cl.[3] ..... H01F 1/00

[52] U.S. Cl. ..... 148/121; 148/31.55

[58] Field of Search ..... 148/120, 121, 122

[56] References Cited

U.S. PATENT DOCUMENTS

| | | | |
|---|---|---|---|
| 4,234,360 | 11/1980 | Frischmann et al. | 148/121 |
| 4,265,684 | 5/1981 | Boll | 148/121 |
| 4,282,046 | 8/1981 | Frischmann et al. | 148/121 |
| 4,286,188 | 8/1981 | Horsinger et al. | 148/121 |
| 4,288,260 | 9/1981 | Senno et al. | 148/121 |
| 4,310,381 | 1/1982 | DeCristofaro | 148/121 |
| 4,347,086 | 8/1982 | Chraplyvy et al. | 148/121 |

FOREIGN PATENT DOCUMENTS

| | | | |
|---|---|---|---|
| 56-257 | 1/1981 | Japan | 148/121 |

*Primary Examiner*—John P. Sheehan

*Attorney, Agent, or Firm*—Antonelli, Terry & Wands

[57] ABSTRACT

A method of heat-treating an amorphous material as that the amorphous material has a high magnetic permeability, is disclosed in which an amorphous material having a Curie temperature $T_c$ higher than or equal to its crystallization temperature $T_x$ is held for a short time at a temperature T satisfying relations $T \geqq 0.95\ T_c$ and $T \geqq T_x$.

3 Claims, No Drawings

METHOD OF HEAT-TREATING AMORPHOUS MATERIAL

This is a continuation of application Ser. No. 368,867, filed Apr. 15, 1982, abandoned.

BACKGROUND OF THE INVENTION

The present invention relates to a method of heat-treating an amorphous magnetic material, and more particularly to a method for readily obtaining an amorphous magnetic material having a high flux density and a high magnetic permeability.

An amorphous magnetic material attracts public attention for the reasons that it has a high magnetic permeability without any magnetic anisotropy resulted from a crystal structure. Especially, there is an amorphous magnetic material containing cobalt Co as their main component with a composition having a saturation magnetostriction constant $\lambda_s$ nearly equal to zero, and the application of such a material to a magnetic head has been energetically studied. In a conventional method for obtaining an amorphous material having a high magnetic permeability from an alloy which contains cobalt as its main component and has no magnetostriction, it is required that the alloy has a composition making its Curie temperature $T_c$ lower than its crystallization temperature $T_x$, and is held at a temperature $T_a$ satisfying a relation $T_c<T_a<T_x$ for a predetemined period to remove thermal strain generated in forming the amorphous material. In more detail, the above-mentioned temperature $T_x$ indicates a crystallization starting temperature in the case where the temperature of the alloy is raised at a rate of about 5° C./min. When the alloy is held at a temperature higher than or equal to the crystallization starting temperature $T_x$, the crystallization generally proceeds, and its magnetic characteristic is deteriorated. However, in the case where the alloy having a composition making the Curie temperature $T_c$ lower than the crystallization starting temperature $T_x$ is heat treated in the manner described above, the saturation flux density $B_s$ of the alloy is 9.0 KG at most, and therefore the alloy does not suffice to form a magnetic head capable of satisfying recent demand for high recording density. In order to solve this problem, various devices have been hitherto made. For example, heat treatment of a magnetic material in a rotating magnetic field or other means have been used as a method for obtaining an amorphous material having a high magnetic permeability by heat treatment at a temperature lower than the crystallization temperature $T_x$ (and of course below Curie temperature $T_c$) of the magnetic material. However, the above-mentioned heat treatment in a rotating field is required to rotate a magnetic field, and has many difficulties when viewed from a practical standpoint.

SUMMARY OF THE INVENTION

An object of the present invention is to provide a method of heat-treating an amorphous magnetic material which innately has a high saturation flux density and has a composition making its Curie temperature $T_c$ higher than or equal to its crystallization temperature $T_x$ in order that the amorphous magnetic material has a high magnetic permeability.

The present invention is based upon finding that an amorphous magnetic material which is high in saturation flux density $B_s$ and has a composition making its Curie temperature $T_c$ higher than or equal to its crystallization temperature $T_x$, exhibits a high magnetic permeability, when the material is heat-treated in a manner that a heating temperature, a heating time, a heating rate and a cooling rate are appropriately selected and controlled.

DESCRIPTION OF THE PREFERRED EMBODIMENTS

Embodiment 1

An amorphous magnetic material $(Co_{0.94}Fe_{0.06})_{75.3}Si_{4.7}B_{20}$ having a crystallization temperature $T_x$ of 490° C., a Cruie temperature $T_c$ of 510° C., a saturation flux density $B_s$ of 9800 G, and a saturation magnetostriction constant $\lambda_s$ nearly equal to zero was subjected to a heat treatment according to the present invention. The heat treatment was carried out in a manner that a ring-shaped sample made of the above material was inserted into a furnace kept at a predetermined temperature, held in the furnace for a predetermined time, and then cooled with water (at a cooling rate of more than $10^{2}$° C./sec). The magnetic permeability of the amorphous magnetic material thus treated was measured in an alternating field having a frequency of 1 $KH_z$ and a field strength of 5 mOe. The results of measurement are shown in Table 1.

TABLE 1

| | temperature (°C.) | time (min:) | Magnetic permeability $\mu_e$ | other conditions |
|---|---|---|---|---|
| present invention | 490 | 3 | 1,300 | quenching |
| | 500 | 3 | 2,000 | quenching |
| | 510 | 3 | 2,500 | quenching |
| | 540 | 1 | 14,000 | quenching |
| | 560 | 1 | 17,000 | quenching |
| conventional method | 440 | 20 | 7,000 | heat treatment in rotating field |
| conventional method | 480 | 5 | 900 | quenching |

In Table 1, the magnetic permeability $\mu_e$ of the amorphous magnetic material may be 1200 or more, in practical use. Furthermore, although the heat treatment time must be short enough to prevent crystallization of the amorphous magnetic material, it cannot be determined since there are some parameters including the heat treatment temperature. For example, if the treatment temperature is 490° C., the heat treatment time is below 5 minutes. The lower limit of the treatment time is changeable depending on the heattreatment temperature. For example, if the heat treatment temperature is 560° C., the heat treatment time is at least 30 seconds. In Table 1, the heat treatment temperature 490° C.$\approx$0.96 $T_c$ and 560° C.$\approx$1.1 $T_c$. If the temperature is higher than 1.1 $T_c$, the effect of the heat treatment may be degraded. In a preferred embodiment, the heat treatment temperature T is preferablly selected to be $T \lesssim 1.1\ T_c$.

Furthermore, the prior art method at 480° C. (=0.94 $T_c$) in Table 1 is different from the present invention only in the heat treatment temperature.

Embodiment 2

An amorphous magnetic material $\{(Co_{0.918}Fe_{0.005}Mn_{0.077})_{78.3}Si_{12.7}B_9\}_{99.5}Ru_{0.5}$ having a crystallization temperature $T_x$ of 420° C., a Curie temperature $T_c$ of 420° C., a saturation flux density $B_s$ of 9600 G, and a saturation magnetostriction constant $\lambda_s$ nearly equal to zero was subjected to a heat treatment according to the present invention. The heat treatment was carried out in such a manner that a ring-shaped sample made of the above material was inserted into a furnace kept at a predetermined temperature, held in the furnace for a predetermined time, and then cooled with water (at a cooling rate of more than $10^{2°}$ C./sec). The magnetic permeability of the amorphous magnetic material thus treated was measured in an alternating field having a frequency of 1 KHz and a field strength of 5 mOe. The results of measurement are shown in Table 2. As is apparent from Table 2, a maximum permeability of 20,000 was obtained in a temperature region above the Curie temperature $T_c$.

TABLE 2

| | temperature (°C.) | time (min) | magnetic permeability $\mu_e$ | other conditions |
|---|---|---|---|---|
| present invention | 430 | 2 | 6,000 | quenching |
| | 440 | 2 | 8,000 | quenching |
| | 450 | 1 | 10,000 | quenching |
| | 470 | 1 | 20,000 | quenching |

In the above-mentioned embodiments, the sample was held in the furnace kept at a predetermined temperature, as in conventional methods. However, it is more preferably from an industrial point of view to increase the heating rate at which the temperature of the sample is raised, by employing instantaneous heating such as infrared heating.

As mentioned above, according to the present invention, an amorphous magnetic material which innately has a high saturation flux density $B_s$ and has a temperature relation $T_c > T_x$, is able to assume a high magnetic permeability which cannot be obtained by a conventional method in which an amorphous magnetic substance having a temperature relation $T_c < T_x$ is heated at a temperature $T_a$ satisfying a relation $T_c < T_a < T_x$. Therefore, the present invention has a high industrial value.

We claim:

1. A method of heat-treating a Co-base amorphous material having a Curie temperature $T_c$ higher than or equal to the crystallization temperature $T_x$ of said material, comprising a step of holding the amorphous material at a temperature T defined by the following formulae:

$$1.1 \times T_c \geqq T \geqq 0.95 \times T_c$$

and $$T \geqq T_x$$

for a short time ranging from about 30 seconds to about 3 minutes to enhance the magnetic permeability and to prevent crystallization of said material.

2. A method of heat treating an amorphous material according to claim 1, where in said amorphous material is $(Co_{0.94}Fe_{0.06})_{75.3}Si_{4.7}B_{20}$ having a crystallization temperature $T_x$ of 490° C. and a Curie temperature $T_c$ of 510° C. and wherein said amorphous material is held at a temperature in the range of from 490° C. to 560° C. for a period ranging from 1 to 3 minutes and, thereafter, cooled with water at a cooling rate of more than $10^{2°}$ C./sec.

3. A method of heat-treating an amorphous material, $((Co_{0.918}Fe_{0.005}Mn_{0.077})_{78.3}B_9)_{99.5}Ru_{0.5}$, to enhance the magnetic permeability and to prevent crystallization of said amorphous material, said amorphous material having a crystallization temperature Tx of 420° C. and a Curie temperature Tc of 420°, which method comprises holding said amorphous material at a temperature ranging from 430° C. to 470° C. to for a period of time ranging from 1 to 2 minutes, followed by cooling with water at a cooling rate of more than $10^{2°}$ C./sec.

* * * * *